United States Patent [19]

DeVial

[11] 3,990,815

[45] Nov. 9, 1976

[54] FLOW CONTROL DEVICE

[75] Inventor: Raymond Michael DeVial, Beckenham, England

[73] Assignee: Bailey Meters & Controls Limited, Croydon, England

[22] Filed: Sept. 26, 1975

[21] Appl. No.: 617,077

Related U.S. Application Data

[63] Continuation-in-part of Ser. No. 416,174, Nov. 15, 1973, abandoned.

[52] U.S. Cl. ..... 417/326; 417/383; 417/390

[51] Int. Cl.[2] ..... F04B 9/10; F04B 35/02

[58] Field of Search ..... 60/395; 91/36; 417/326, 417/383, 388, 390, 46, 47, 42

[56] References Cited

UNITED STATES PATENTS

| | | | |
|---|---|---|---|
| 1,282,145 | 10/1918 | Tobler | 417/383 |
| 2,954,738 | 10/1960 | De Vette | 417/383 |
| 3,250,226 | 5/1966 | Voelker | 417/390 |
| 3,489,096 | 1/1970 | Wright | 417/383 |

FOREIGN PATENTS OR APPLICATIONS

| | | | |
|---|---|---|---|
| 688,777 | 3/1953 | United Kingdom | 417/383 |
| 1,013,719 | 12/1965 | United Kingdom | 417/383 |

*Primary Examiner*—William L. Freeh

[57] ABSTRACT

A flow control apparatus whereby an incompressible fluid may be supplied at a controlled rate. The apparatus includes a pair of chambers and a cylinder and piston in communication with one of said chambers and an incompressible fluid fitting that chamber. The piston has a motor connected thereto for moving same in the cylinder and a follower is associated with said motor so as to rotate at a speed that is proportional to that of the motor.

4 Claims, 3 Drawing Figures

FLOW CONTROL DEVICE

This application is a continuation-in-part of application Ser. No. 416,174, filed Nov. 15, 1973, now abandoned.

Problems can arise in many circumstances from the contamination of a liquid.

It is, for instance, undesirable that any contaminant should be present in the working fluid that is circulated between a turbine and a boiler and there is a danger that oil from oil-fired boilers will become included in the working fluid. Again, during the deballasting operation of tankers, oil may escape into the seaways producing undesirable pollution, whilst the effluent from a land-based process discharging into a river could lead to an unacceptable pollution of the river.

Various devices have therefore been evolved to respond to the contamination of a liquid; a device that is especially suitable for use in monitoring the presence of oil in water has been described and claimed in our British Patent No. 1,232,581. Where the device is to be used with only one liquid and one contaminant, or where the characteristics of the liquid and contaminants are known, the device can be calibrated in advance. The present invention is concerned to facilitate the calibration of such devices and is especially useful when the device is to be calibrated anew.

According to the present invention, there is provided apparatus by which an incompressible fluid may be supplied at a controlled rate, the apparatus including a first chamber which can be filled with fluid and having an outlet through which the fluid can be expressed, the boundaries of the chamber being rigid except for a deformable membrane, a further chamber of which the boundaries include the deformable membrane and are otherwise rigid, a cylinder in communication with the further chamber, a piston operable within the cylinder, an incompressible fluid filling the further chamber and the space within the cylinder that is bounded by the piston, a motor arranged to move the piston in the cylinder, a follower associated with the motor so as to rotate at a speed that is proportional to that of the motor, a device associated with the follower and rotatable concentrically with the follower at a constant speed, and means responsive to the separation between the follower and the device whereby the speed of the motor is varied in the sense that maintains the separation constant.

Figure 1:
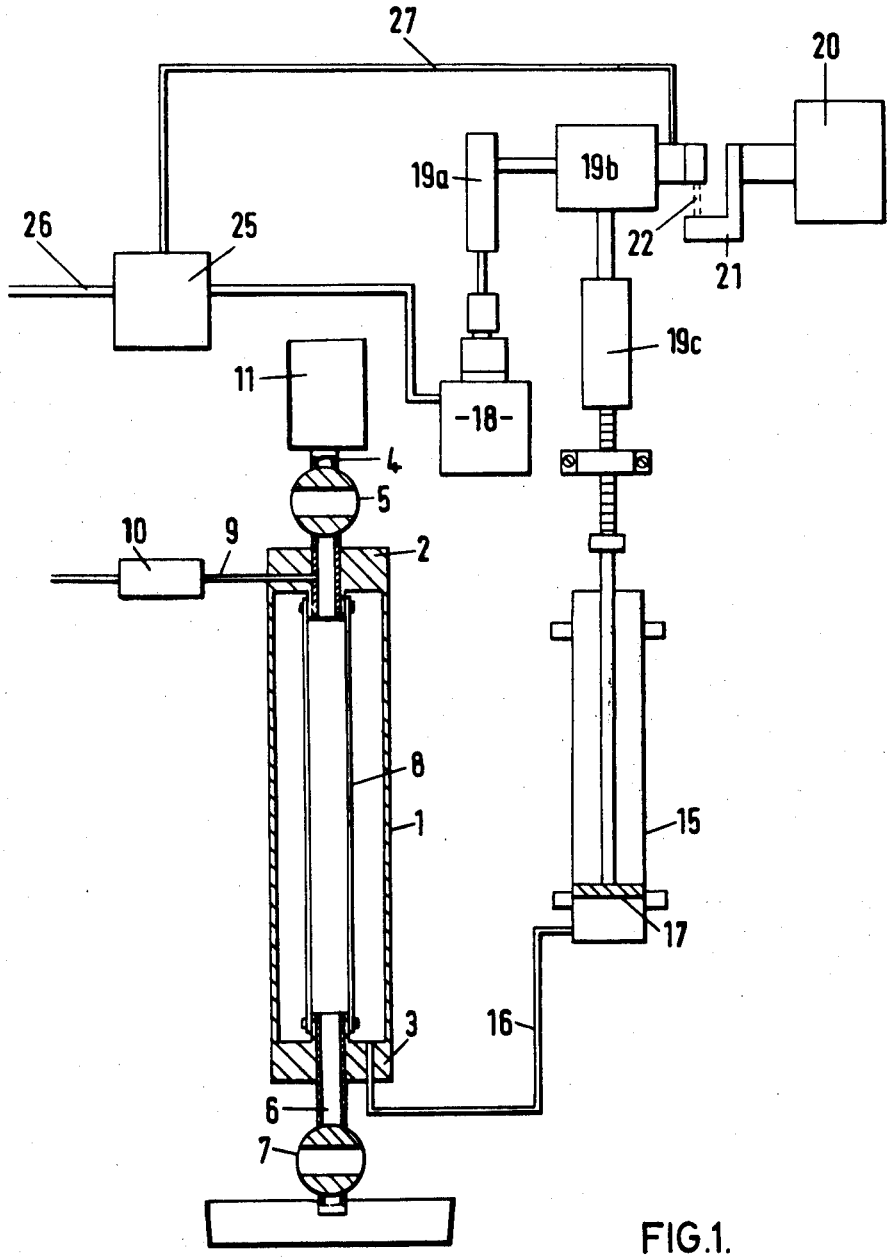
Figure 2A:
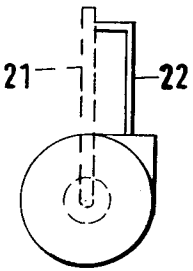
Figure 2:
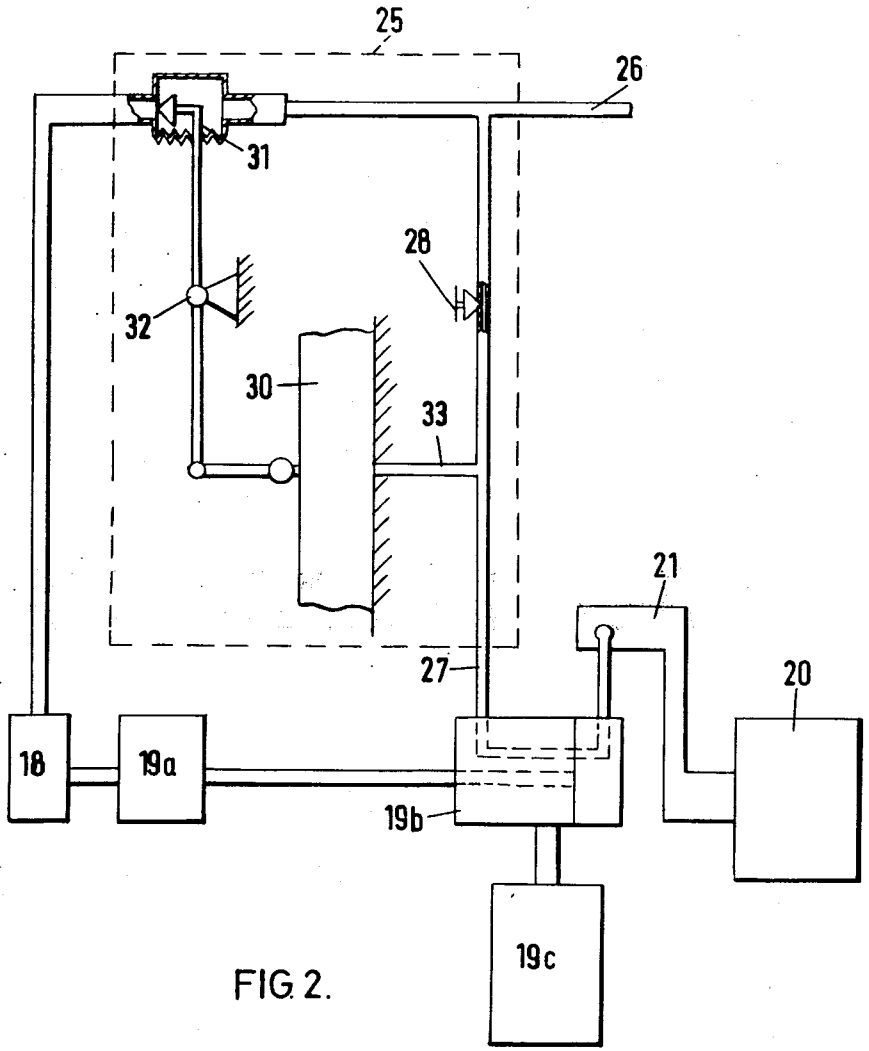

By way of example, apparatus embodying the invention will now be described with reference to the accompanying schematic drawings in which FIG. 1 shows generally apparatus designed to enable a device responsive to the presence of a hydrocarbon fluid in sea water to be calibrated easily at sea;

FIG. 2 is a detail illustrating certain components of FIG. 1; and

FIG. 2*a* is an end view of components included in FIG. 2.

The apparatus illustrated in FIG. 1 includes an upright cylinder 1 having caps 2 and 3 at its upper and lower ends. A pipe 4, containing an inlet valve 5, penetrates the upper cap and a pipe 6, containing an outlet valve 7 penetrates the lower cap. Between the inner ends of the pipes 4 and 6, within the cylinder 1, there extends a flexible tube 8 of Viton or other elastomer. A duct 9 penetrates the upper cap 2 to communicate with the interior of the tube 8. The outlet end of the duct 9 is closed by a non-return or other back pressure valve 10. Upstream of the inlet valve 5 is a supply hopper 11, and a drain trough is situated beneath the lower, outlet end of the duct.

An hydraulic cylinder 15 is connected by a short pipe 16 that extends from the lower end of the cylinder 15 to the upright cylinder 1, opening into the space between the tube 8 and the upright cylinder 1 and penetrating the lower cap 3. A piston 17 is reciprocable in the hydraulic cylinder 15 and is connected to be reciprocated by an air motor through gearing 19 that causes the piston to rotate about its axis during longitudinal movement. Hydraulic oil occupies the part of the hudraulic cylinder, between the piston and the end of the cylinder from which the duct 16 leads the duct 16, and the space within the rigid cylinder 1 between it and the tube 8.

The piston 17 is actuated by the air motor 18 through the gearing 19*c*, that is included in the gear sequence 19*a*, 19*b*, and 19*c*, and to ensure that the piston 17 moves at a constant speed, the rate of operation of the air motor 18 is controlled to be constant by the air clock 20.

Air to operate the air motor 18 is supplied through the relay 25 from the air inlet 26. Operation of the motor 18 drives the gearing 19*a* which in turn drives the gearing 19*b* and 19*c*, the latter meshing with the gearing 19*b* so that its speed of operation is proportional to that of the gearing 19*b*. The gearing 19*b* also rotates a discharge nozzle 22 that serves as a follower to a vane 21 driven by the clock 20. The vane 21 and nozzle 22 rotate around a common axis.

As is best shown in FIG. 2, the nozzle 22 is supplied with air from the inlet 26 through a connection 27. The relay 25 contains a bellows 30 and a valve 31 included in the pipe by which the air motor 18 is supplied. A pivotted link 32 connects the bellows 30 to the valve 31 so that as the former expands the latter opens, and as the latter contracts, the latter closes. A connection 33 puts the space within the bellows 30 into communication with the pipe 27.

The clock 20 will rotate at a constant speed — four revolutions per hour in this particular example. If the motor 18 starts to rotate too slowly, then the nozzle 22 will move closer to the vane 21, restricting the escape of air through the nozzle 22 and so increasing the pressure in the pipe 27. This will cause the bellows 30 to expand and, through the linkage 32, open the valve 31 so that more air will flow to the motor 18, to increase its speed and restore the gap between the nozzle 22 and the vane 21. The motor will thus continue to operate at its intended speed and the piston 17 will consequently move at its intended rate. The reverse effect occurs if the motor 18 starts to revolve too quickly.

Now suppose it is intended to calibrate apparatus (not shown) by which a response may be produced to the presence of a contaminant in a liquid. The piston 17 is withdrawn away from the end of the hydraulic cylinder 15 to which the pipe 16 is connected. A sample of the contaminant is then run into the tube 8 from the hopper 11, valve 6 being first closed, and the inlet valve 5 being closed subsequently when the tube is full. The air motor 18 is then put into operation so as to move the piston 17 in the hydraulic cylinder 15 in the sense that drives hydraulic fluid into the space between the tube 8 and the rigid cylinder 1. This inflow of liquid will deform the tube 8 to express contaminant through the duct 9. The rate at which the contaminant is discharged will depend upon the rate of operation of the air motor and is maintained at a constant rate by the control of the motor by the follower and the relationship of the follower to the vane that is rotated at a constant speed by the air clock. To withdraw the piston 17 after it has completed its forward stroke, i.e. after it has expelled hydraulic fluid, the air motor is run in reverse.

Since the contaminant is supplied at a constant rate that is known from the rate of movement of the piston, the calibration of the apparatus that is to be calibrated can be effected by discharging the duct 9 into liquid flowing at a known rate and passing the mixture through the apparatus.

If the rate at which contaminant is to be expressed is to be varied, the variation can be achieved by altering the speed of the clock 18 or adjusting the proportion of the rate of movement of the nozzle 22 relatively to the rate of movement of the piston 17.

The apparatus that has been described can be arranged to operate automatically after it has been switched on so that little skill is required for its use. It can therefore be widely used, on ship and elsewhere. It can be used with a wide range of contaminants provided that the tube 8, and the flow path of which it forms part, is washed before a different contaminant is used. The characteristics of the contaminant may be unknown and the apparatus is such that it may be safely used even in a hazardous atmosphere. Since the contaminant remains entirely separate from the hydraulic fluid, the latter can be chosen to ensure smooth steady movement of the piston 17 whilst the contaminant may be dirty, sandy, or gritty, viscous and non-lubricating, subject only to the requirement that it does not block the non-return valve 10.

We claim:

1. Apparatus by which an incompressible fluid may be supplied at a controlled rate, the apparatus including a first chamber which can be filled with fluid and having an outlet through which the fluid can be expressed, the boundaries of the chamber being rigid except for a deformable membrane, a further chamber of which the boundaries include the deformable membrane and are otherwise rigid, a cylinder in communication with the further chamber, a piston operable within the cylinder, an incompressible fluid filling the further chamber and the space within the cylinder that is bounded by the piston, a motor arranged to move the piston in the cylinder, a follower associated with the motor so as to rotate at a speed that is proportional to that of the motor, a device associated with the follower and rotatable concentrically with the follower at a constant speed, and means responsive to the separation between the follower and the device whereby the speed of the motor is varied in the sense that maintains the separation constant.

2. Apparatus as claimed in claim 1, in which the device is a vane that is mounted on an air clock.

3. Apparatus as claimed in claim 1 in which the follower is arranged to discharge air towards the device so that the pressure within the follower is dependent upon the separation between the device and the follower and the means arranged to vary the speed of the motor is dependent upon this pressure.

4. Apparatus as claimed in claim 3, in which the motor is an air motor.

* * * * *